US008403417B2

(12) United States Patent
Huang

(10) Patent No.: US 8,403,417 B2
(45) Date of Patent: Mar. 26, 2013

(54) ARMREST STRUCTURE

(76) Inventor: Tsung-Wen Huang, Changhua County (TW)

( * ) Notice: Subject to any disclaimer, the term of this patent is extended or adjusted under 35 U.S.C. 154(b) by 106 days.

(21) Appl. No.: 13/197,447

(22) Filed: Aug. 3, 2011

(65) Prior Publication Data

US 2013/0033082 A1 Feb. 7, 2013

(51) Int. Cl.
*A47C 7/54* (2006.01)
*B60N 2/46* (2006.01)

(52) U.S. Cl. ..... 297/411.35; 297/411.36; 297/411.37

(58) Field of Classification Search ..... 297/411.35, 297/411.36, 411.37
See application file for complete search history.

(56) References Cited

U.S. PATENT DOCUMENTS 7,387,341 B1 * 6/2008 Tsai ..... 297/411.35
7,828,389 B2 * 11/2010 Oda ..... 297/411.36
2006/0226691 A1 * 10/2006 Bedford et al. ..... 297/411.36
2012/0025584 A1 * 2/2012 Chen et al. ..... 297/411.37
2012/0175934 A1 * 7/2012 Bock ..... 297/411.37

* cited by examiner

*Primary Examiner* — David Dunn
*Assistant Examiner* — Alexander Harrison

(57) ABSTRACT

An armrest structure includes a cover and a controlling member which has a pressing portion and a rack portion respectively formed on two sides thereof. A sliding plate has a sliding protrusion and multiple teeth which are engaged with the rack portion. A fixing plate has a sliding groove and the sliding protrusion is slidably engaged with the sliding groove. A fixing device has a sliding area and two first rails. The sliding plate is engaged with the first rails. The fixing device has a recessed area in which the fixing plate is located. The fixing device has multiple engaging teeth engaged with the rack portion, and two guide grooves. A base is connected with the cover and has two second rails which are engaged with the two guide grooves. A height adjustment device is connected to a slot of the fixing device and fixed to the fixing plate.

7 Claims, 18 Drawing Sheets

ARMREST STRUCTURE

FIELD OF THE INVENTION

The present invention relates to an armrest structure, and more particularly, to a chair armrest structure which adjusts the armrest in horizontal and vertical directions.

BACKGROUND OF THE INVENTION

A conventional armrest structure is shown in FIGS. 13 to 16 and generally includes a armrest case 81 with a fixing device 82 at the underside thereof and the fixing device 82 has a rack portion 821 on a side thereof and a ridge 822 is located at the underside thereof so that the rail 83 of the armrest case 81 is allowed to move upward. A fixing plate 84 includes a tooted portion 841 on each of two sides thereof and fixing posts 842 are located at the underside thereof so as to be accommodated in the hole 823 of the fixing device 82 and respectively fixed to the armrest (not shown). Two gears 85 are respectively located on two sides of the fixing device 82 and the teeth 851 are engaged with the toothed portion 841 of the fixing plate 84. An adjustment member 86 has a first toothed portion 861 which is engaged with the teeth 851 of the gears 85, and the second toothed portion 862 is engaged with the rack portion 821 of the fixing device 82. The spring 863 of the adjustment member 86 is located between the controlling portion 864 and the stop 811 of the case 81. When adjusting the armrest back and forth, the adjustment member 86 is pressed to compress the spring 863 so that the first toothed portion 861 is separated from the teeth 851, and the second toothed portion 862 is separated from the rack portion 821 as shown in FIG. 14. The user holds the case 81 and moves the rail 83 of the case 81 along the ridge 822 of the fixing device 82 so that the case 81 can be moved back and forth. When the case 81 is moved to a desired position, the adjustment member 86 is released and the spring 863 moves the adjustment member 86 back to its original position. The first toothed portion 861 of the adjustment member 86 is engaged with the teeth 851 of the gear 85, and the second toothed portion 862 is engaged with the rack portion 821 of the fixing device 82 to position the case 81 as shown in FIG. 15.

When adjusting the case 81 left and right, the adjustment member 86 is pressed to compress the spring 863 so that the first toothed portion 861 is separated from the teeth 851, and the second toothed portion 862 is separated from the rack portion 821. The user holds the case 81 and moves hole 823 relative to the fixing posts 842 of the fixing member 84, and the teeth 851 is rotatable relative to the toothed portion 841 of the fixing plate 84 to swing the case 81. When the case 81 is moved to a desired position, the adjustment member 86 is released and the spring 863 moves the adjustment member 86 back to its original position. The way that the adjustment member 86 moves is the same as the previous mentioned way to position the case 81 as shown in FIG. 16.

As shown in FIGS. 17 and 18, the pivotal portion 92 of the pivotal frame 91 is connected to the chair and the engaging portion 93 of the pivotal frame 91 has multiple slots 94 located in the hollow movable case 95 which includes multiple positioning recesses 96 in the top of inside thereof. The pivotal shaft 971 of the engaging rod 97 is engaged with the positioning recesses 96. The engaging rod 97 has a hook 972 at the bottom thereof and an operation portion 973 is formed on the top of the engaging rod 97. When adjusting the height of the armrest, the user pivots the operation portion 973 located outside of the movable case 95, the engaging rod 97 is pivoted about the pivotal shaft 971 to shift the hook 972 away from the slot 94 of the pivotal frame 91, so that the movable case 95 can be moved upward and downward. When the user releases the operation portion 973 of the engaging rod 97, the hook 972 swings due to the weight of the engaging rod 97 and hooks the slot 94 to position the armrest.

When the armrest is adjusted in horizontal direction, the fixing plate extends through the hole of the fixing device and is fixed to the pivotal arm on the armrest so as to form a pivotal point. The adjustment member is disengaged from the gears and the fixing device, the frame moves relative to the ridge of the fixing device so that the case can be moved back and forth. However, when the armrest is moved left and right, the action has to be proceed after the action for adjusting the armrest back and forth, or the action for adjusting the armrest left and right uses the hole relative to the fixing posts of the fixing device, and the teeth of the gears pivotal relative to the toothed portion of the fixing member. Once the armrest is positioned, the first toothed portion of the adjustment member is engaged with the teeth of the gears, and the second toothed portion is engaged with the toothed portion of the fixing device. Accordingly, the adjustment and positioning of the armrest is mainly relied on the distance between the teeth of the gears to adjust the gears so as to set the horizontal distance, and the engagement of the gears and the related parts. If the teeth are narrow and thin, then the adjustment can be made more precisely, but the teeth are easily broken. On the contrary, if the teeth are wide and thick, the adjustment can only be made at larger scale and the teeth are more strong and durable. The precise and fine teeth of the gears require the toothed portion of the fixing device and the toothed portion of the fixing member to be precise and fine, and this means higher manufacturing cost is needed.

Besides, for the height adjustment, the engaging rod is pivoted relative to the pivotal shaft to let the hook to be hooked to the slots of the pivotal frame. However, the engaging rod easily contacts the operation portion unintentionally to disengage the hook from the slot to affect the adjustment of the height of the armrest. This is a problem to be improved.

The present invention intends to provide an armrest structure which improves the shortcomings of the conventional armrests.

SUMMARY OF THE INVENTION

The present invention relates to an armrest structure and comprises a cover and a controlling member which has a spring and a pressing portion which is located on one side of the pressing portion. A rack portion is formed on the other side of the controlling member. A sliding plate has a sliding protrusion at the underside thereof and multiple teeth are formed on a side of the sliding plate so as to be engaged with the rack portion. A fixing plate has a sliding groove and the sliding protrusion is slidably engaged with the sliding groove. A fixing device has a sliding area and two first rails are respectively located on two sides of the fixing device. The sliding plate is engaged with the first rails. The fixing device has a recessed area and the fixing plate is located in the recessed area. The recessed area has a slot and the fixing device has multiple engaging teeth on a side thereof so as to be engaged with the rack portion of the controlling member. Two guide grooves are defined in the underside thereof. A base is connected with the cover and has an opening and the recessed area is located in the opening. The base has two second rails which are engaged with the two guide grooves. A height adjustment device is connected to the slot of the fixing device and fixed to the fixing plate.

The present invention has the following improvements:

1. When the armrest is adjusted, the sliding protrusion is moved within the sliding groove of the fixing plate, so that the armrest does not restricted by the teeth of the toothed portion. The structural strength of the mechanism is improved.

2. When the armrest is adjusted back and forth, or left and right, the teeth of the sliding plate and the engaging teeth of the fixing device are in flush with each other, so that when the armrest is moved to a desired position, the user only controls the engagement between the rack portion of the controlling member and the teeth of the sliding plate to easily position the armrest.

3. When the armrest is adjusted it height, by pulling the lever in vertical direction to move the push portion in the inclined slot, and to use the force of the spring, the hook can hook the aperture of the pivotal frame to proceed the height adjustment of the armrest. This action is not affected by exterior impact.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
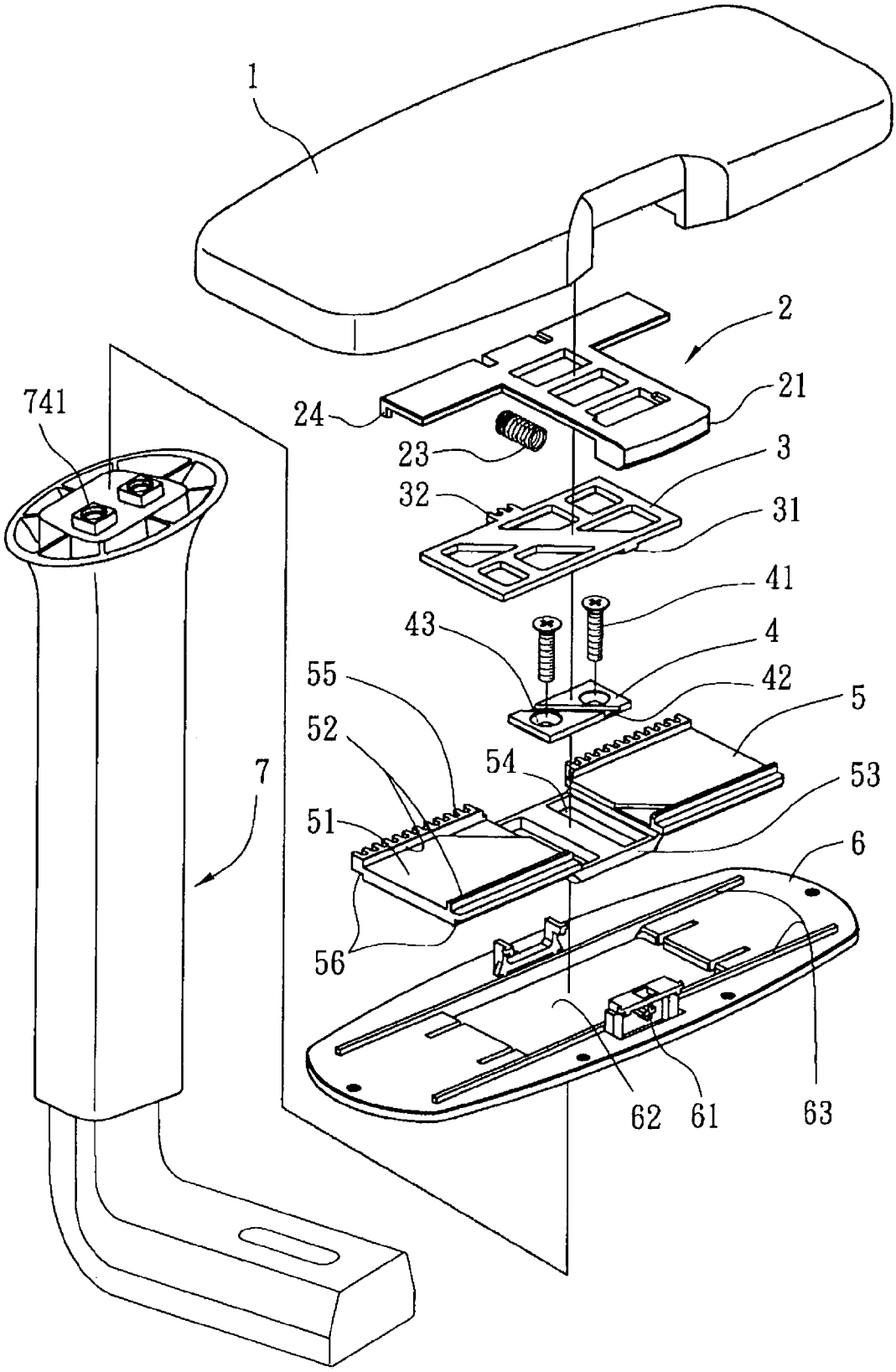
FIG. 1 is an exploded view to show the armrest of the present invention.
Figure 2:
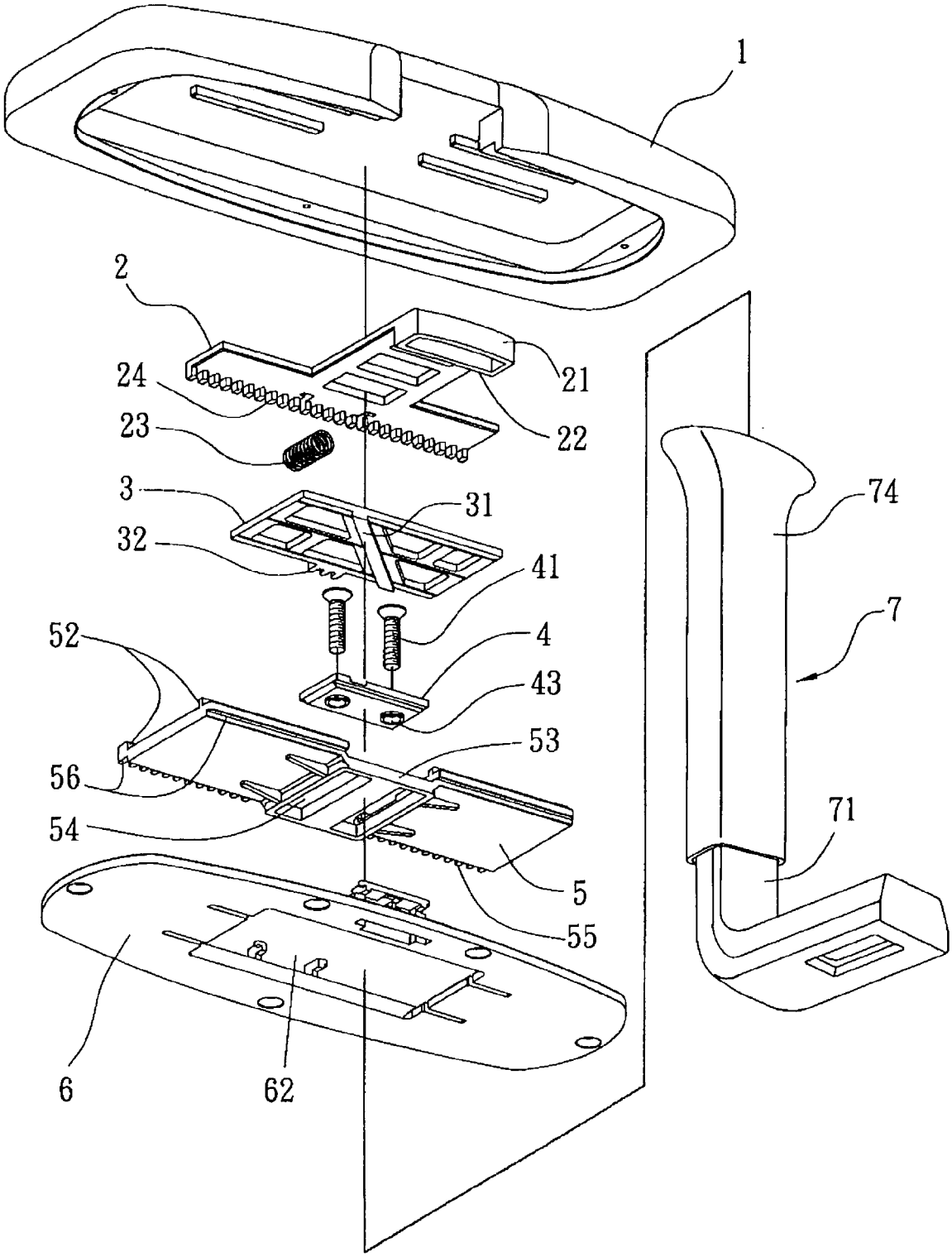
FIG. 2 is another exploded view to show the armrest of the present invention.
Figure 3:
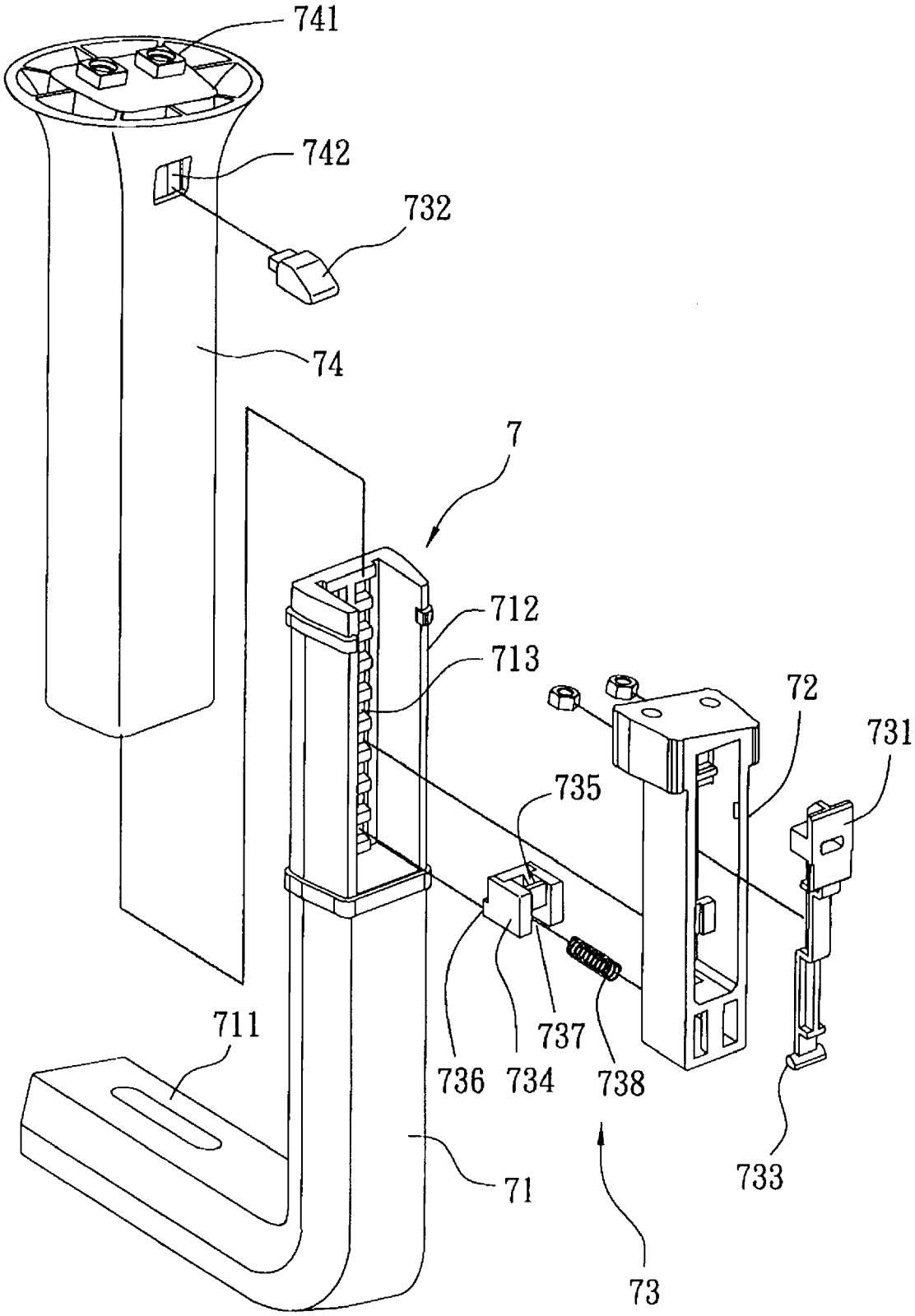
FIG. 3 is an exploded view to show the height adjustment device of the present invention.
Figure 4:
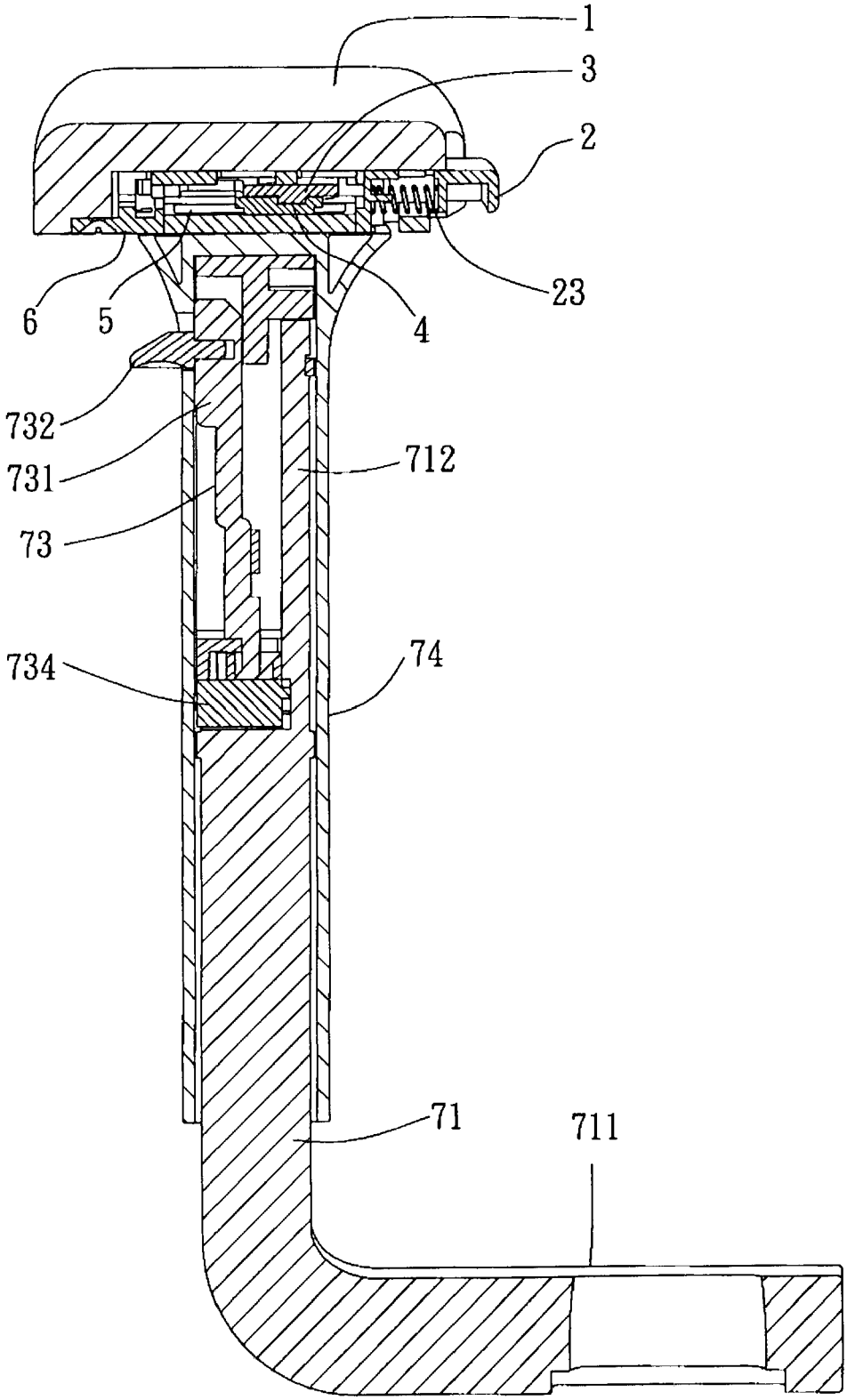
FIG. 4 is a cross sectional view of the armrest of the present invention.

Referring to FIGS. 1 to 4, the armrest of the present invention comprises a cover 1 and a controlling member 2 which has a pressing portion 21 on one side thereof and a spring 23 contacts against a contact portion 22 in the inside of the pressing portion 21. A rack portion 24 is formed on the other side of the controlling member 2.

A sliding plate 3 has a sliding protrusion 31 at the underside thereof and multiple teeth 32 are formed on one side of the sliding plate 3 so as to be engaged with the rack portion 24.

A fixing plate 4 has a fixing member 41 and a sliding groove 42 is defined in the fixing member 41. The sliding protrusion 31 is slidably engaged with the sliding groove 42. The fixing member 41 extends through a hole 43 in the fixing plate 4.

A fixing device 5 has a sliding area 51 on the top thereof and two first rails 52 are respectively located on two sides of the sliding area 51 of the fixing device 5. The sliding plate 3 is engaged with the first rails 52. The fixing device 5 has a recessed area 53 defined in the center thereof and the fixing plate 4 is located in the recessed area 53. The recessed area 53 has a slot 54 defined therein. The fixing device 5 has multiple engaging teeth 55 on a side thereof so as to be engaged with the rack portion 24 of the controlling member 2. Two guide grooves 56 are defined in the underside thereof.

A base 6 is connected with the cover 1 and has a tube 61 on an end thereof and the spring 23 of the controlling member 2 is located in the tube 61, and the spring 23 contacts the controlling member 2. An opening 62 is defined centrally through the base 6 and the recessed area 53 is located in the opening 62. The base 6 has two second rails 63 which are engaged with the two guide grooves 56.

A height adjustment device 7 comprises a pivotal frame 71, a reception member 72, multiple engaging parts 73 and a movable case 74. The pivotal frame 71 has a pivotal portion 711 on the first end thereof and the pivotal portion 711 is connected with a chair. The second end of the pivotal frame 71 has an engaging portion 712 which has multiple apertures 713. The reception member 72 accommodates the engaging parts 73. The engaging parts 73 comprise a lever 731, an engaging block 734 and a spring 738. The lever 731 has a latch 732 on the first end thereof and the second end of the lever 731 has a push portion 733. The engaging block 734 has an inclined slot 735 defined therein and the push portion 733 of the lever 731 is engaged with the inclined slot 735. The engaging block 734 has a hook 736 at the first end thereof so as to hook one of the apertures 713 of the pivotal frame 71. The engaging block 734 has a room 737 and the spring 738 is received in the room 737. The movable case 74 provides an inner space so that the reception member 72 is located therein and the movable case 74 has a connection member 741 which protrudes beyond the top of the movable case 74 so as to be connected with the fixing plate 4 and the slot 54 of the fixing device 5. The cover 1 and the base 6 are connected to each other, the slot 54 of the fixing device 5 is extended to the connection member 741. The movable case 74 is mounted to the engaging portion 712 of the pivotal frame 71. The movable case 74 has a through hole 742 and the latch 732 of the lever 731 is engaged with the through hole 742.

When assembling, the recessed area 53 of the fixing device 5 is located in the opening 62 of the base 6 and the guide grooves 56 of the fixing device 5 is slidably engaged with the second rails 63. The fixing plate 4 is installed in the recessed area 53 and the fixing member 41 extends through the hole 43 of the fixing plate 4 and the slot 54 of the fixing device 5 so as to be connected to the connection member 741 of the movable case 74 of the height adjustment device 7. The slot 54 of the fixing device 5 is slidably relative to the connection member 741 of the movable case 74 of the height adjustment device 7 and the fixing plate 4. The two ends of the sliding plate 3 are located in the first rails 52 of the sliding area 51 and the sliding protrusion 31 is engaged with the sliding groove 42 of the fixing plate 4. The spring 23 is installed in the tube 61 and contacts the contact portion 22 of the controlling member 2. The rack portion 24 of the controlling member 2 are nagged with the engaging teeth 55, the teeth 32. The cover 1 is connected to the base 6. The engaging parts 73 are located in the reception member 72 and the hook 736 of the engaging block 734 hooks one of the apertures 713 of the pivotal frame 71. The spring 738 is located between the room 737 and the reception member 72. The push portion 733 of the lever 731 is located in the inclined slot 735. The reception member 72 having the engaging parts 73 received therein is located in the movable case 74 and fixed by the fixing member 41. The movable case 74 is movable by movement of the engaging block 734 of the lever 731 so as to be engaged with the apertures 713 of the pivotal frame 71.

Figure 5:
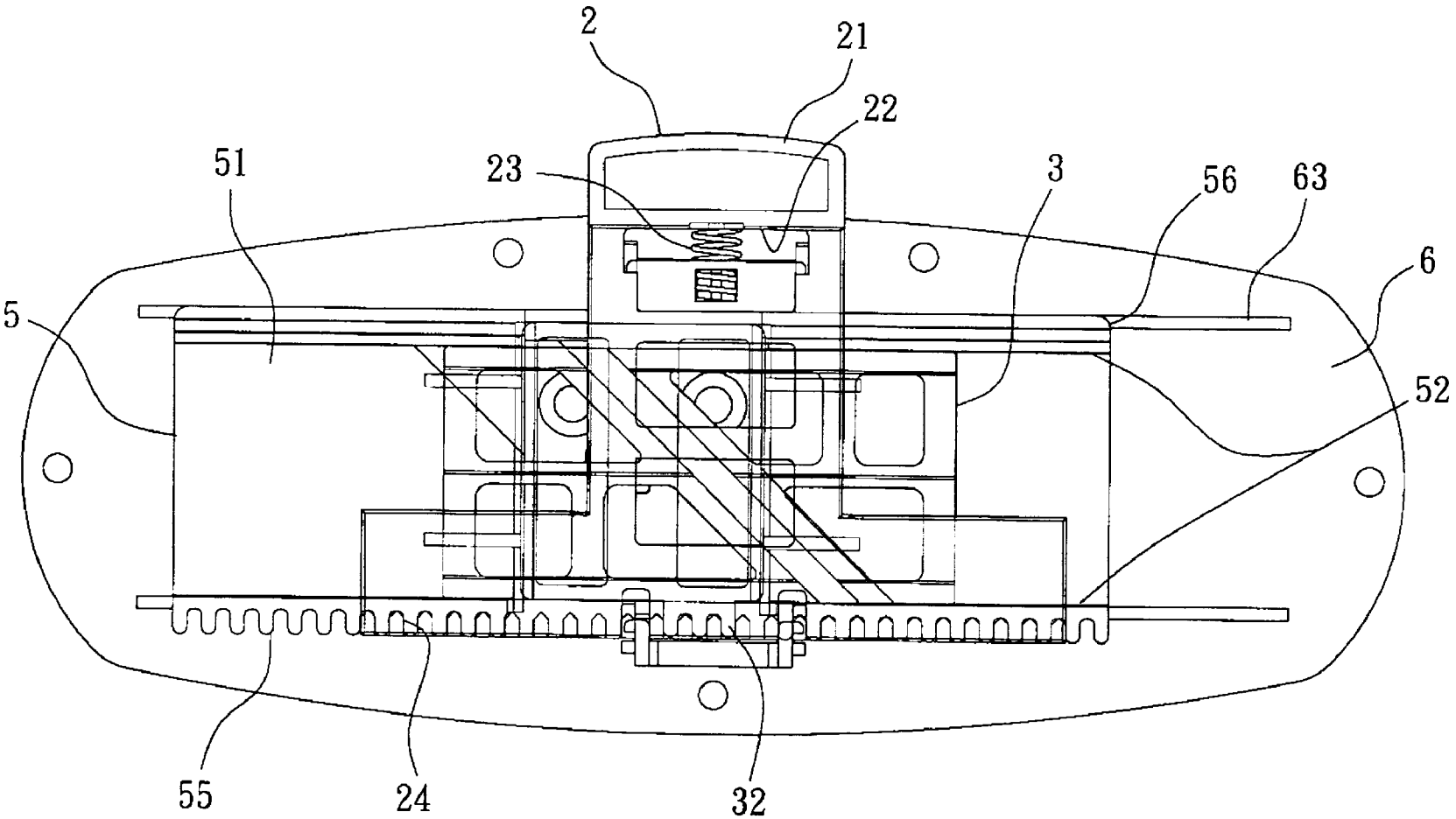
FIG. 5 shows that the controlling member the armrest of the present invention is in locked status.
Figure 6:
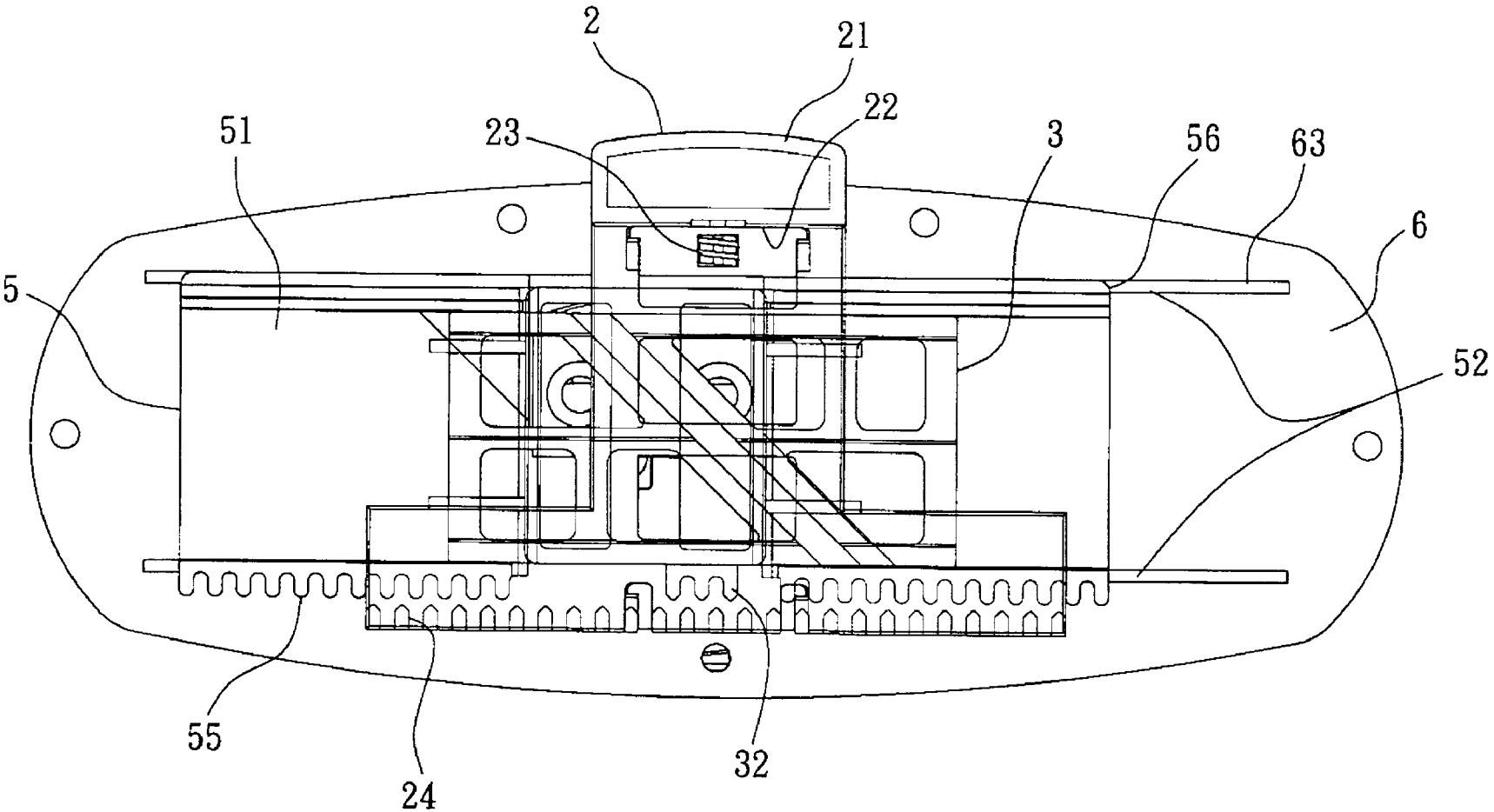
FIG. 6 shows that the controlling member the armrest of the present invention is in unlocked status.
Figure 7:
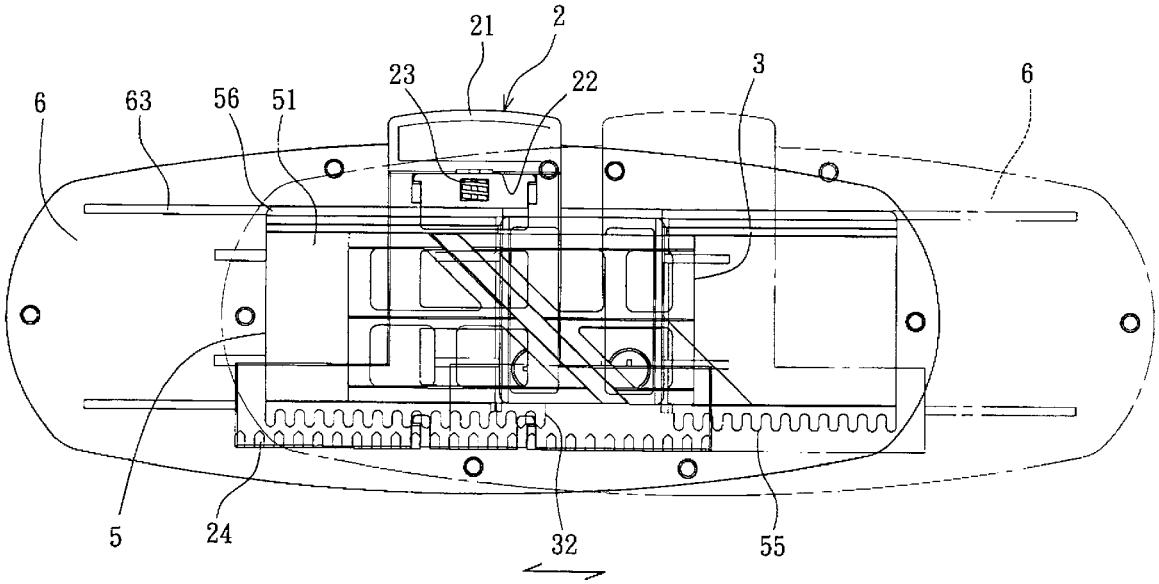
FIG. 7 shows the actions when adjusting the armrest in horizontal direction.
Figure 8:
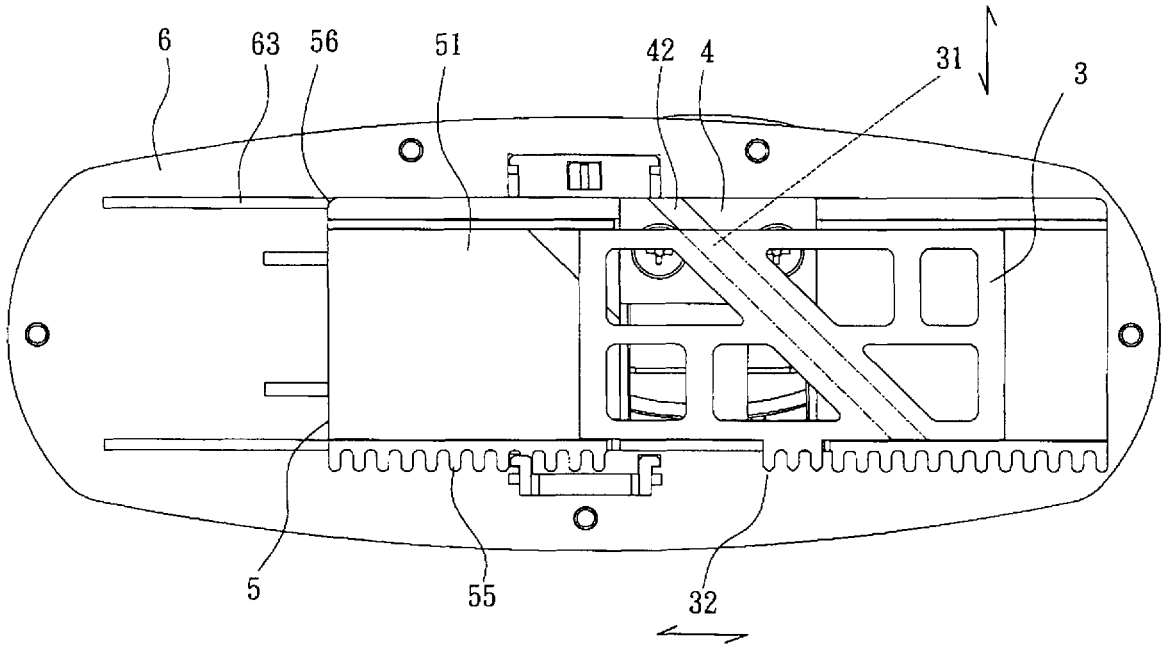
FIGS. 8 and 9 show the actions when the armrest is adjusted left and right.
Figure 9:
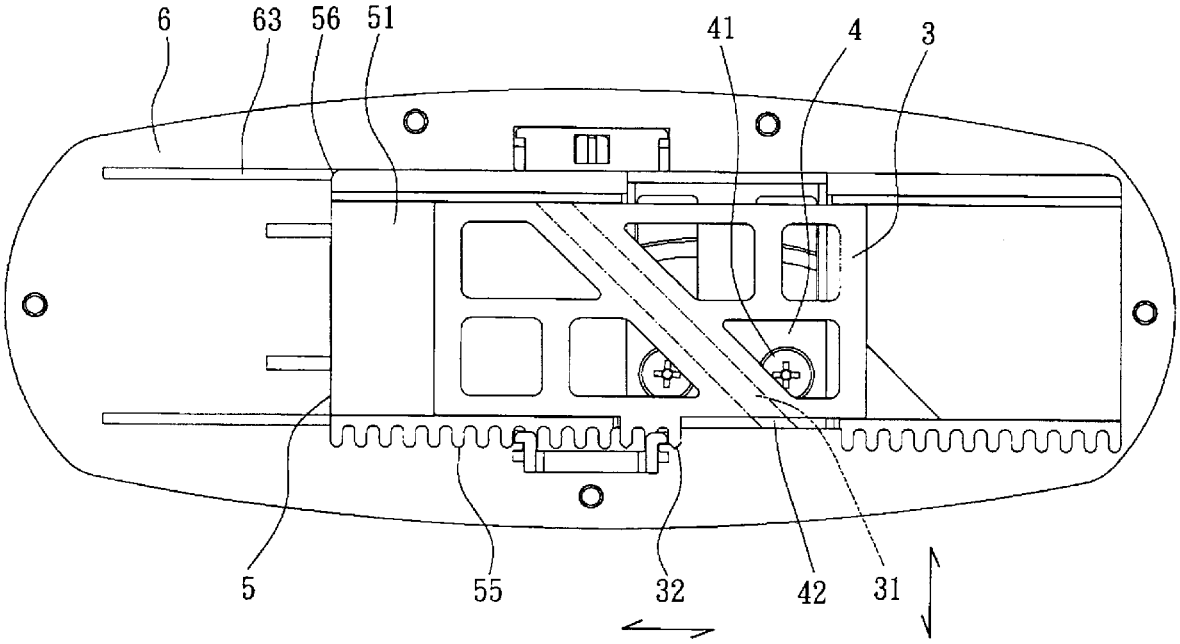

As shown in FIGS. 2, 5, 6 and 7, when adjusting the armrest back and forth in the horizontal direction, the pressing portion 21 is pressed and the spring 23 is compressed by the contact portion 22, the rack portion 24 is disengaged from the engaging teeth 55 of the fixing device 5 and the teeth 32 of the sliding plate 3. The user can move the cover 1 and the base 6 back and forth by moving the second rails 63 relative to the guide grooves 56. When the armrest is adjusted to a desired position, the pressing portion 21 is released, the spring 23 bounces back, and the rack portion 24 is engaged with the engaging teeth 55 of the fixing device 5 and the teeth 32 of the sliding plate 3 to position the armrest. Similarly, as shown in FIGS. 1, 2, 5, 6, 8 and 9, when adjusting the armrest left and right in the horizontal direction, when the rack portion 24 is disengaged from the engaging teeth 55 of the fixing device 5 and the teeth 32 of the sliding plate 3. The user can move the cover 1 and the base 6 to move the guide grooves 56 of the fixing device 5 by the second rails 63 of the base 6. The sliding plate 3 in the sliding area 51 uses the sliding protrusion 31 to move left and right in the sliding groove 42 of the fixing plate 4. When the armrest is adjusted to a desired position, the pressing portion 21 is released, the spring 23 bounces back, and the rack portion 24 is engaged with the engaging teeth 55 of the fixing device 5 and the teeth 32 of the sliding plate 3 to position the armrest.

Figure 10:
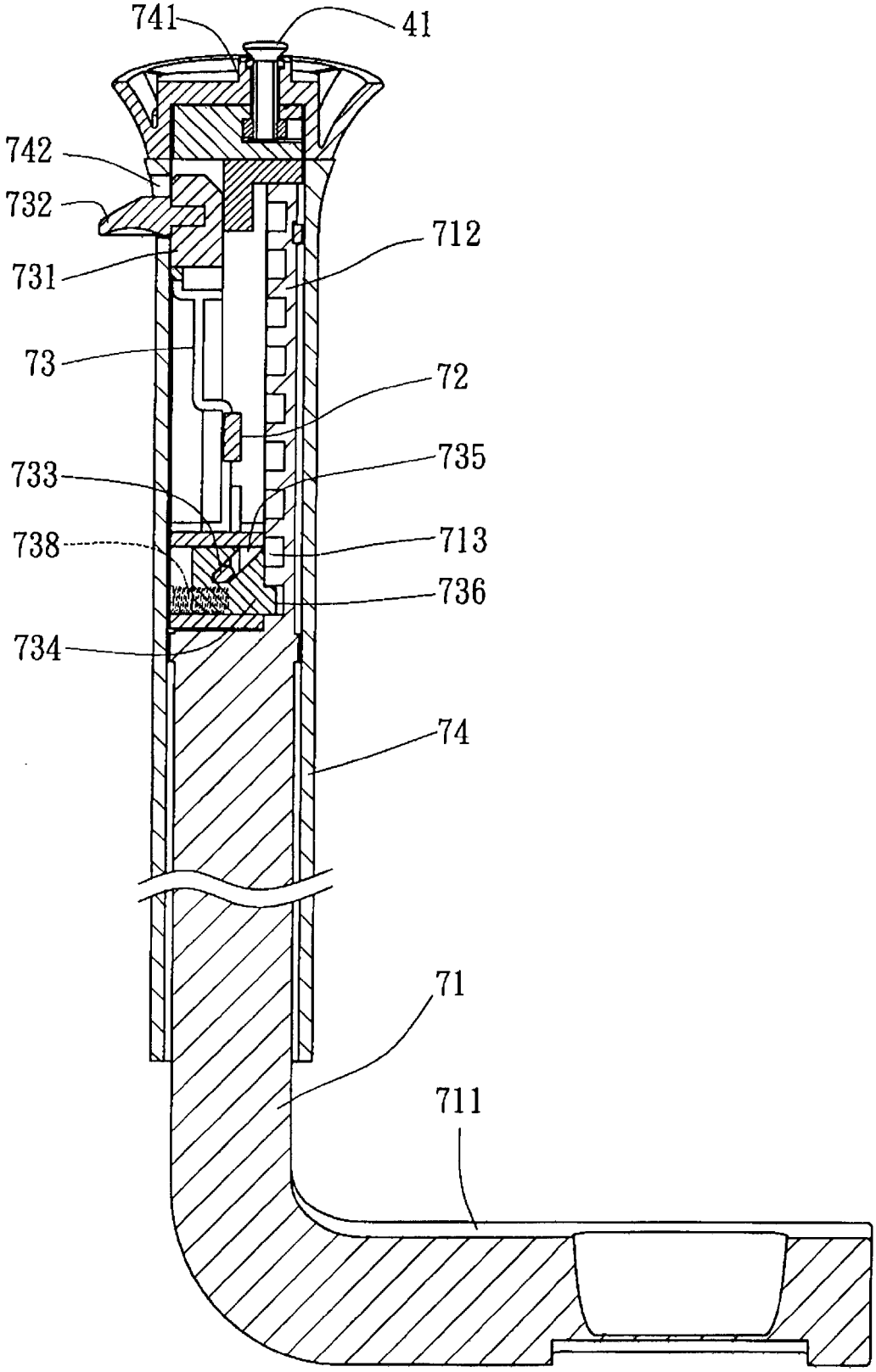
FIGS. 10 to 12 show the actions when adjusting the armrest in vertical direction.
Figure 11:
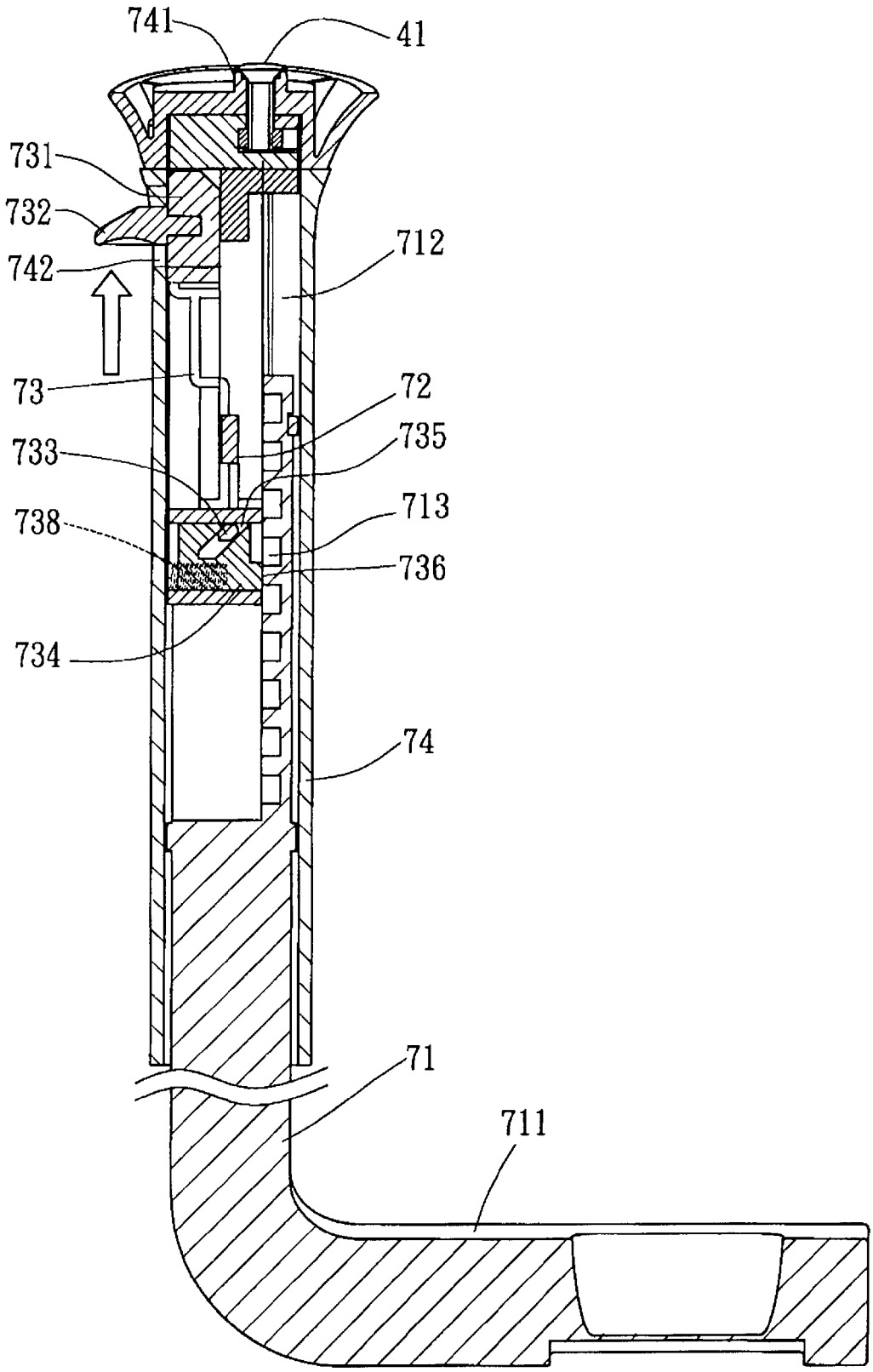
Figure 12:
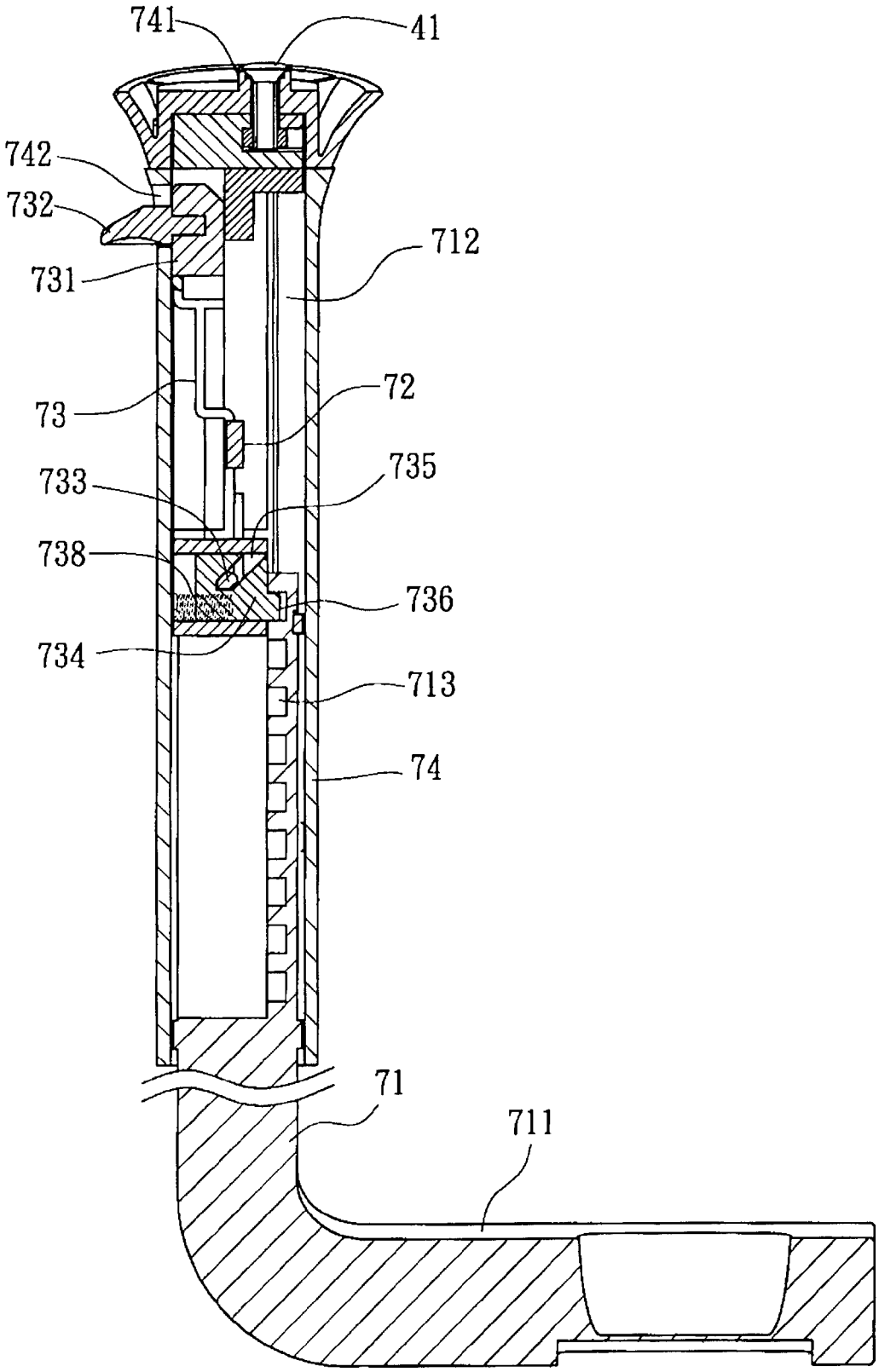
Figure 13:
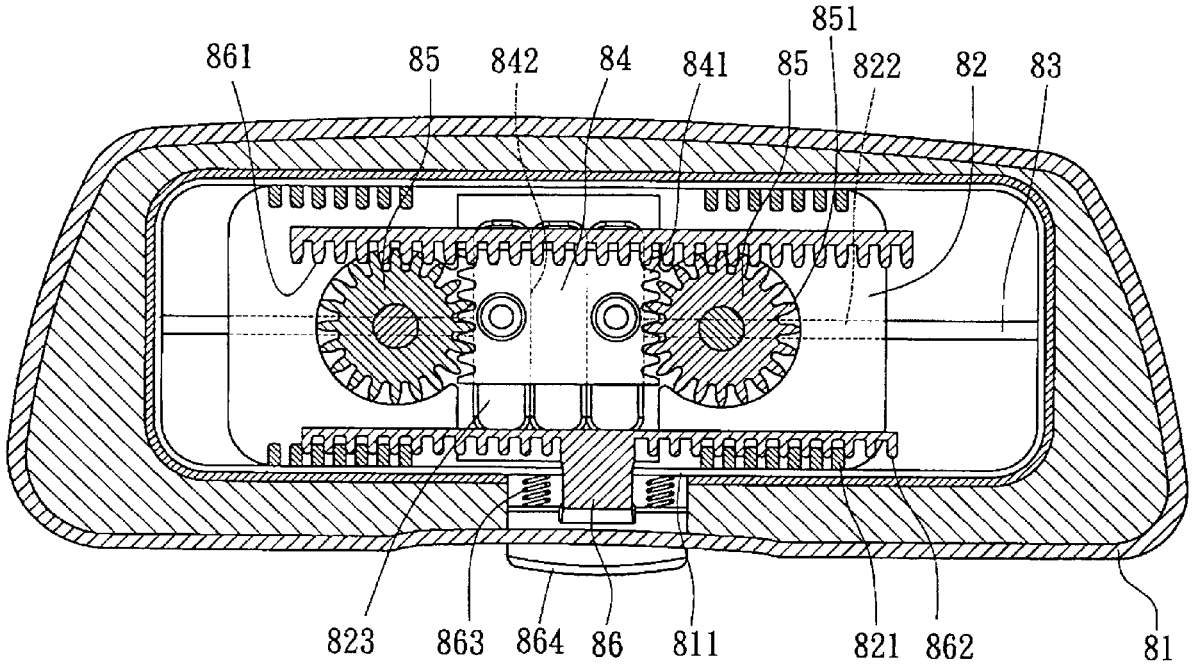
FIG. 13 PRIOR ART
FIG. 13 is a cross sectional view of the conventional armrest.
Figure 14:
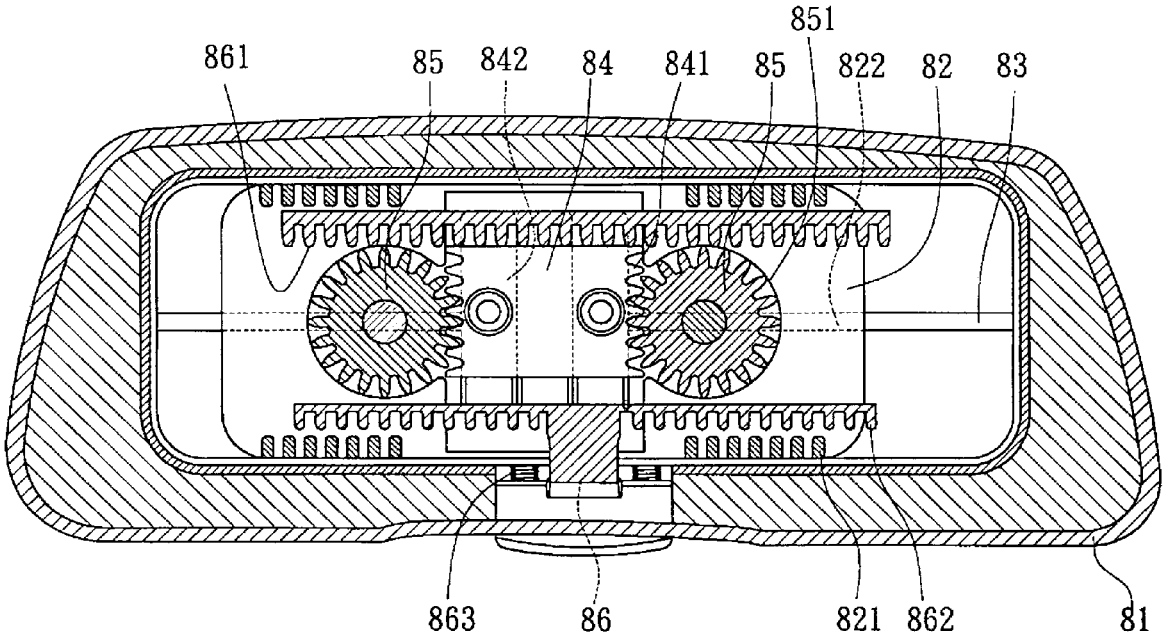
FIG. 14 PRIOR ART
FIG. 14 shows that the adjustment member and the toothed portion of the fixing device of the conventional armrest are disengaged from each other
Figure 15:
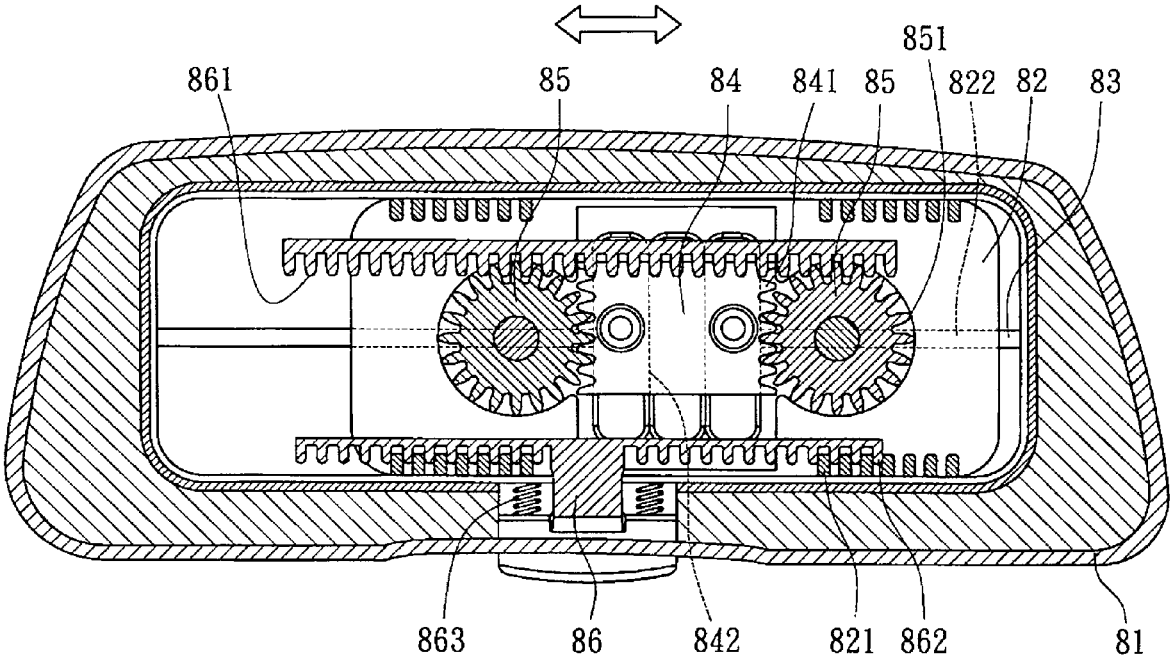
FIG. 15 PRIOR ART
FIG. 15 is a cross sectional view to show that the armrest is adjusted back and forth and positioned in horizontal direction.
Figure 16:
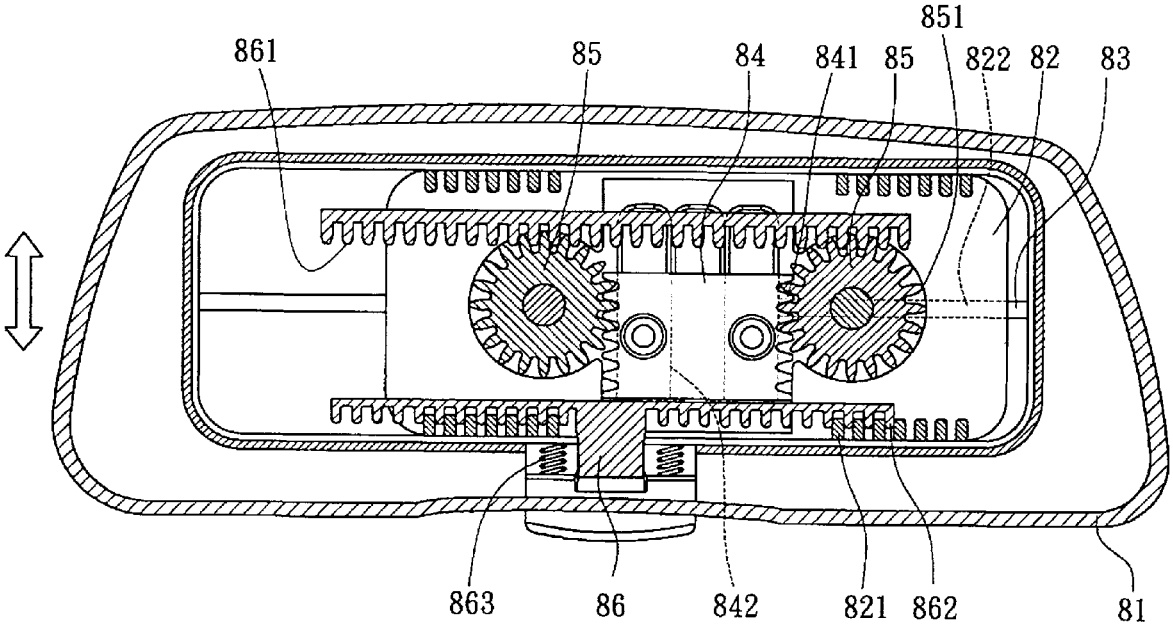
FIG. 16 PRIOR ART
FIG. 16 is a cross sectional view to show that the armrest is adjusted left and right and positioned in horizontal direction.
Figure 17:
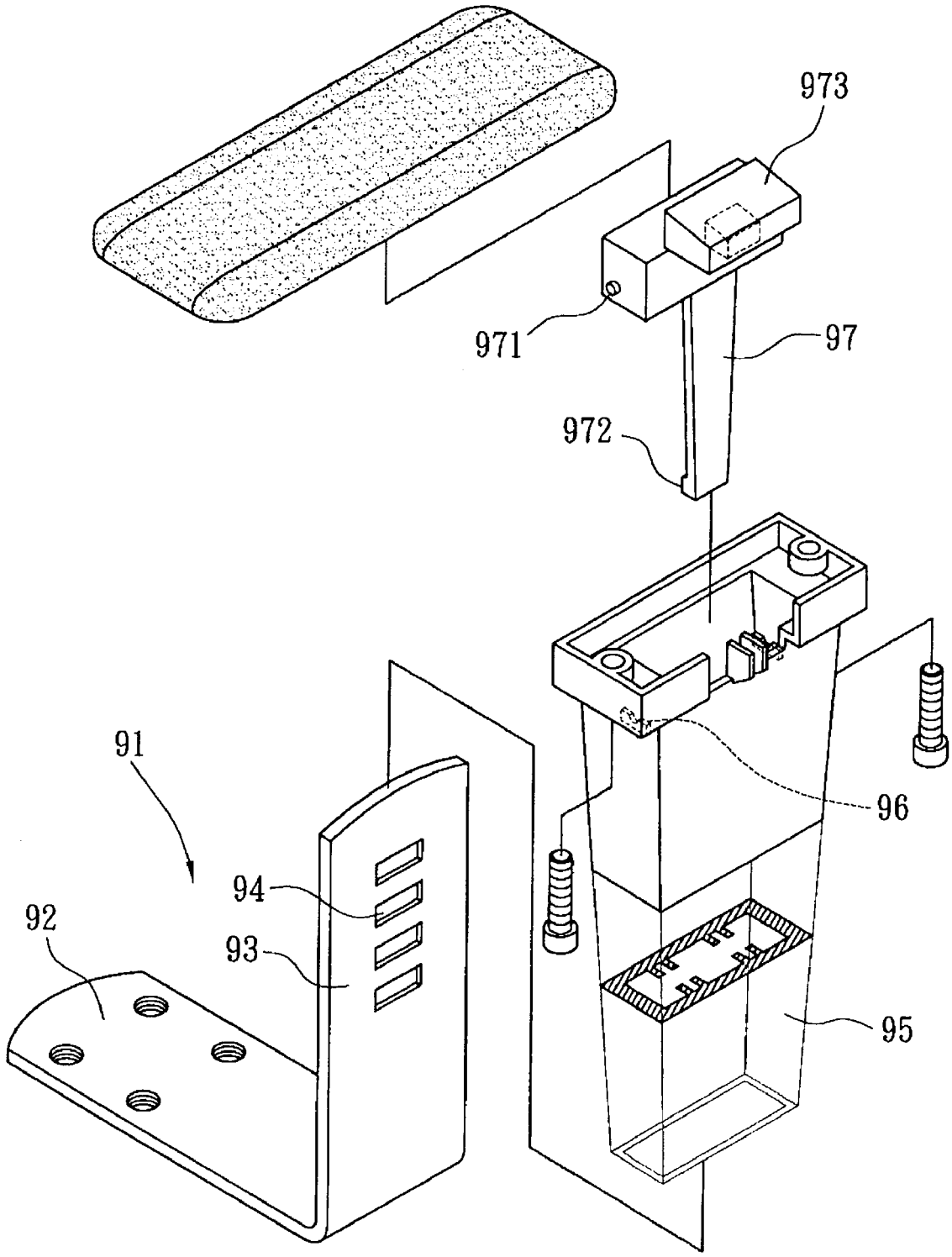
FIG. 17 PRIOR ART
FIG. 17 is an exploded view to show the conventional armrest.
Figure 18:
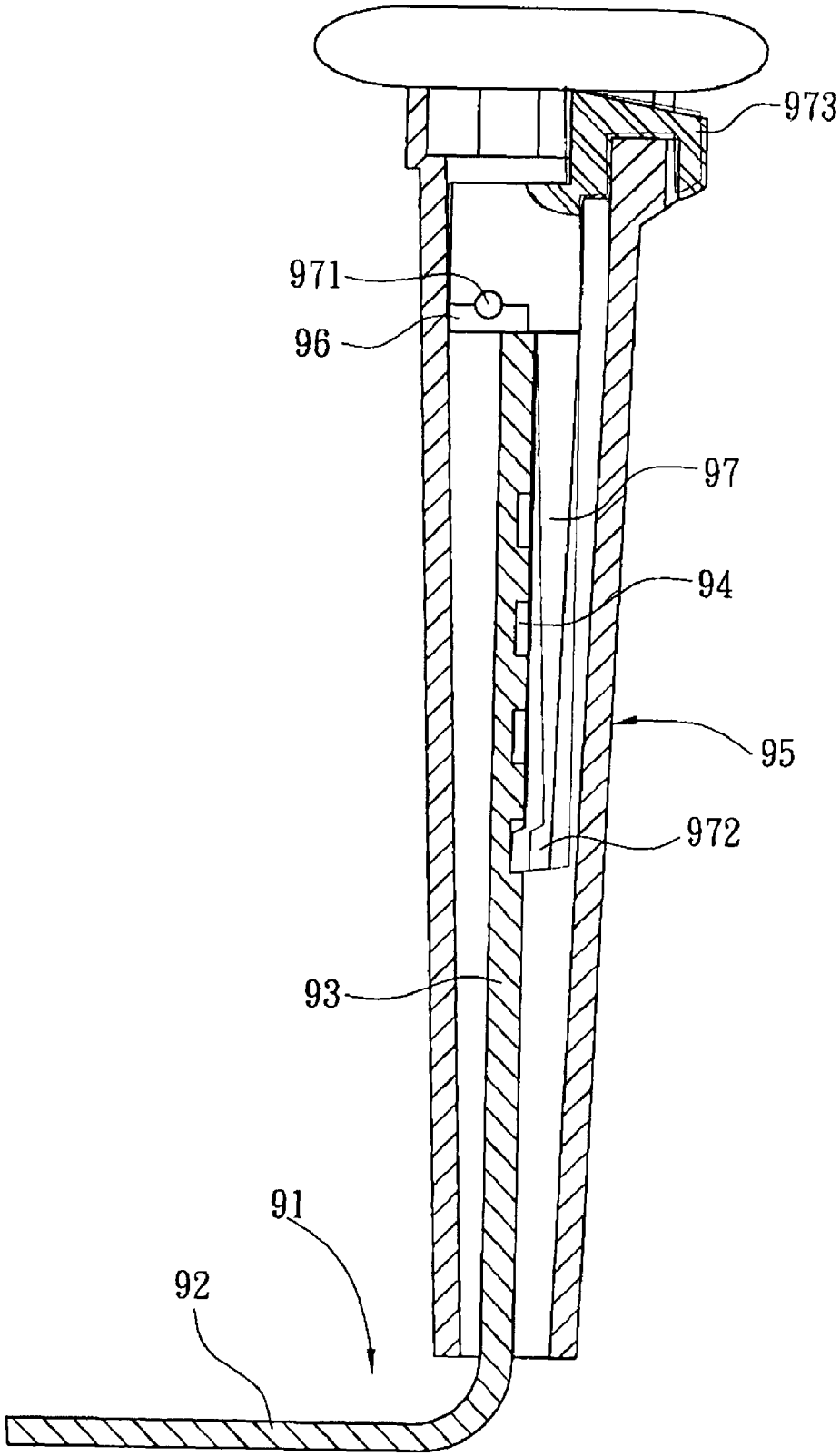
FIG. 18 PRIOR ART
FIG. 18 is a cross sectional view of the conventional armrest.

As shown in FIGS. 3, 4, and 10 to 12, when adjusting the armrest in vertical direction, the latch 732 of the engaging parts 73 located outside of the movable case 74 is lifted upward so that the push portion 733 of the lever 731 moves vertically in the reception member 72. Because the inclined slot 735 is used only for the push portion 733 to move, so that when the moving force of the push portion 733 is transferred to the top edge of inclined slot 735 of the engaging block 734, the engaging block 734 moves backward to compress the spring 738 to disengage the hook 736 from the aperture 713 of the pivotal frame 71. The movable case 74 and the reception member 72 are then moved together to move the armrest up and down. When releasing the latch 732 of the lever 731, the spring 738 bounces back and the engaging block 734 moves horizontally. By the guidance of the inclined slot 735, the latch 732 and the push portion 733 move vertically and downward, and the hook 736 hooks the aperture 713 of the pivotal frame 71 to achieve the purpose of adjustment of the height of the armrest.

When the armrest is adjusted, the sliding protrusion is moved within the sliding groove of the fixing plate, so that the armrest does not restricted by the teeth of the toothed portion. The structural strength of the mechanism is improved. When the armrest is adjusted back and forth, or left and right, the teeth of the sliding plate and the engaging teeth of the fixing device are in flush with each other, so that when the armrest is moved to a desired position, the user only controls the engagement between the rack portion of the controlling member and the teeth of the sliding plate to easily position the armrest. When the armrest is adjusted it height, by pulling the lever in vertical direction to move the push portion in the inclined slot, and to use the force of the spring, the hook can hook the aperture of the pivotal frame to proceed the height adjustment of the armrest. This action is not affected by exterior impact.

While we have shown and described the embodiment in accordance with the present invention, it should be clear to those skilled in the art that further embodiments may be made without departing from the scope of the present invention.

What is claimed is:

1. An armrest structure comprising:

a cover (1);

a controlling member (2) having a spring (23) and a pressing portion (21) located on one side thereof, a rack portion (24) formed on the other side of the controlling member (2);

a sliding plate (3) having a sliding protrusion (31) at an underside thereof and multiple teeth (32) formed on a side of the sliding plate (3) so as to be engaged with the rack portion (24);

a fixing plate (4) having a sliding groove (42) defined therein and the sliding protrusion (31) slidably engaged with the sliding groove (42);

a fixing device (5) having a sliding area (51) on a top thereof and two first rails (52) respectively located on two sides of the fixing device (5), the sliding plate (3) engaged with the first rails (52), the fixing device (5) having a recessed area (53) defined in a center thereof and the fixing plate (4) located in the recessed area (53), the recessed area (53) having a slot (54) defined therein, the fixing device (5) having multiple engaging teeth (55) on a side thereof so as to be engaged with the rack portion (24) of the controlling member (2), two guide grooves (56) defined in an underside thereof;

a base (6) connected with the cover (1) and having an opening (62) defined centrally therethrough and the recessed area (53) located in the opening (62), the base (6) having two second rails (63) which are engaged with the two guide grooves (56), and a height adjustment device (7) connected to the slot (54) of the fixing device (5) and fixed to the fixing plate (4).

2. The armrest structure as claimed in claim 1, wherein the height adjustment device (7) comprises a pivotal frame (71), multiple engaging parts (73) and a movable case (74), the pivotal frame (71) has a pivotal portion (711) on a first end thereof and the pivotal portion (711) is adapted to be connected with a chair, a second end of the pivotal frame (71) has an engaging portion (712) which has multiple apertures (713), the engaging parts (73) comprise a lever (731), an engaging block (734) and a spring (738), the lever (731) has a latch (732) on a first end thereof and a second end of the lever (731) has a push portion (733), the engaging block (734) has an inclined slot (735) defined therein and the push portion (733) of the lever (731) is engaged with the inclined slot (735), the engaging block (734) has a hook (736) at a first end thereof so as to hook one of the apertures (713) of the pivotal frame (71), the engaging block (734) has a room (737) and the spring (738) is received in the room (737), the movable case (74) is mounted to the engaging portion (712) of the pivotal frame (71), the movable case (74) has a through hole (742) and the latch (732) of the lever (731) is engaged with the through hole (742).

3. The armrest structure as claimed in claim 2, wherein the movable case (74) of the height adjustment device (7) has a connection member (741) which protrudes beyond a top of the movable case (74) so as to be connected with the fixing plate (4) and the slot (54) of the fixing device (5), the slot (54) of the fixing device (5) extended to the engaging block (741).

4. The armrest structure as claimed in claim 1, wherein the controlling member (2) has a contact portion (22) which is located at an inside of the pressing portion (21) and the spring (23) contacts the contact portion (22).

5. The armrest structure as claimed in claim 3, wherein the base (6) has a tube (61) and the spring (23) is located in the tube (61).

6. The armrest structure as claimed in claim 1 further comprising a fixing member (41) which extends through the slot (54) of the fixing device (5) and is connected to the height adjustment device (7).

7. The armrest structure as claimed in claim 2, wherein the height adjustment device (7) has a reception member (72) in which the engaging parts (73) are received, the reception member (72) is located in the movable case (74).

* * * * *